US006032013A

United States Patent [19]

Niizawa

[11] Patent Number: 6,032,013

[45] Date of Patent: Feb. 29, 2000

[54] DEVELOPING AGENT SUPPLY APPARATUS AND DEVELOPING AGENT CONTAINER USED IN THE SAME

[75] Inventor: Koji Niizawa, Toyohashi, Japan

[73] Assignee: Minolta Co., Ltd., Osaka, Japan

[21] Appl. No.: 09/310,225

[22] Filed: May 12, 1999

[30] Foreign Application Priority Data

May 15, 1998 [JP] Japan ..... 10-133052

[51] Int. Cl.[7] ..... G03G 15/08

[52] U.S. Cl. ..... 399/262; 399/258; 222/DIG. 1

[58] Field of Search ..... 222/167, 169, 222/DIG. 1; 399/106, 258, 259, 262; 141/363, 364, 383, 384

[56] References Cited

U.S. PATENT DOCUMENTS

| | | | |
|---|---|---|---|
| 4,641,945 | 2/1997 | Ikesue et al. . | |
| 5,794,108 | 8/1998 | Yoshizawa et al. | 399/262 |
| 5,822,663 | 10/1998 | Ichikawa et al. | 399/262 |
| 5,828,935 | 10/1998 | Tatsumi et al. | 399/260 |

*Primary Examiner*—Matthew S. Smith
*Assistant Examiner*—Hoang Ngo
*Attorney, Agent, or Firm*—Morrison & Foerster LLP

[57] ABSTRACT

A developing agent supply apparatus capable of preventing a developing agent from staining hands and/or clothes of an operator, the apparatus and around the same by gushing out as dusty smoke when the operator pulls out an empty developing agent container from the apparatus. A developing agent container used in the developing agent supply apparatus includes a projection portion formed in an outer surface thereof which includes a first surface and a second surface. The developing agent supply apparatus includes a first engagement portion formed in an inner peripheral surface of a coupling into which the container is detachable mounted, and a second engagement portion formed in a support portion for guiding the container into or out from the coupling. According to the developing agent supply apparatus, when the coupling is rotated in a predetermined direction with the container mounted to the coupling, the first engagement portion abuts and pushes the first surface of the projection portion so that the container is rotated in the predetermined direction, and when the container is pulled out from the coupling, the second surface of the projection portion abuts the second engagement portion, thereby movement of the container is temporarily restricted before the container is completely pulled out from the coupling.

11 Claims, 5 Drawing Sheets

DEVELOPING AGENT SUPPLY APPARATUS AND DEVELOPING AGENT CONTAINER USED IN THE SAME

CROSS-REFERENCE TO RELATED APPLICATIONS

This application is based on Japanese Patent Application No. 10-133052 filed in Japan on May 15, 1998, the contents of which are hereby incorporated by reference.

BACKGROUND OF THE INVENTION

1. Field of the Invention

The present invention relates to a developing agent supply apparatus which is used in an image forming apparatus, such as a copying machine and a printer, and also to a developing agent container which is used in a developing agent supply apparatus.

2. Description of Related Art

A developing agent supply apparatus of a type which requires to insert a toner bottle (developing agent container) containing toner particles (developing agent) into a supply apparatus is already in an actual use in an image forming apparatus such as a copying machine. When using this type of a developing agent supply apparatus, in accordance with a toner empty warning sign, one pulls out an empty toner bottle from the supply apparatus and replaces the empty toner bottle with a new toner bottle which is filled with toner particles.

However, when one pulls out the empty toner bottle, in a moment the toner bottle is pulled by great force out from the supply apparatus, toner particles remaining within the supply apparatus and toner particles within the toner bottle gush out as dusty smokes, thereby staining the hands and/or clothes of the operator, the image forming apparatus and around the same.

SUMMARY OF THE INVENTION

An object of the present invention is to provide an improved developing agent supply apparatus which solves the problem described above, and a developing agent container which is used in such a developing agent supply apparatus.

A further object of the present invention is to provide a developing agent supply apparatus which prevents a developing agent from staining around the developing agent supply apparatus as dusty smokes when a developing agent container is pulled out from the developing agent supply apparatus, and to provide a developing agent container which is used in such a developing agent supply apparatus.

The objects above are achieved by a developing agent supply apparatus which comprises:

a developing agent container comprising a projection portion disposed in an outer surface of the container, the projection portion comprising a first surface and a second surface;

a cylindrical coupling into which the developing agent container is detachable mounted, the coupling comprising a first engagement portion which is formed in an inner peripheral surface of the coupling; and a second engagement portion, wherein when the coupling is rotated in a predetermined direction with the developing agent container mounted to the coupling, the first engagement portion abuts and pushes the first surface of the projection portion so that the developing agent container is rotated in the predetermined direction, and wherein when the developing agent container is pulled out from the coupling, the second surface of the projection portion abuts the second engagement portion, whereby movement of the developing agent container is temporarily restricted before the developing agent container is completely pulled out from the coupling.

The developing agent supply apparatus described above may further comprise a support portion which guides the developing agent container into the coupling or out from the coupling, and the supply portion may comprise the second engagement portion. It is desirable that a contact surface of at least one of the projection portion and the second engagement portion is inclined when the developing agent container is fit into the coupling guided by the support portion.

Further, there may be two such projection portions, two such first engagement portions and two such second engagement portions.

The developing agent container may have a cylindrical shape and comprise a spiral projection in an inner peripheral surface of the container.

Further, the developing agent supply apparatus described above may further comprise drive means for drive-rotating the coupling.

In the developing agent supply apparatus according to the present invention structured as above, as the first engagement portion of the coupling abuts and pushes the first surface of the projection portion of the developing agent container, the developing agent container is rotated only in the predetermined direction. Hence, when the coupling is in a halt, it is possible to manually rotate the developing agent container by hand in a direction in which the first surface of the projection portion separates from the first engagement portion, namely, the same direction as the predetermined direction described above. Therefore, during replacement of the developing agent container, even when the developing agent container is not in a halt at a predetermined rotation position which allows to pull out the container from the coupling because of some reason, it is possible to rotate the developing agent container to the predetermined rotation position in an easy manner.

Further, when the developing agent container is pulled out, as the second surface of the projection portion abuts the second engagement portion, movement of the developing agent container is temporarily stopped before an edge portion of the developing agent container exits the coupling, which prevents the developing agent container from jumping out of the coupling, and hence, a developing agent remaining within the coupling or the developing agent container from gushing out and scattering as dusty smokes.

Still further, in the developing agent supply apparatus according to the present invention, where at least one of the projection portion and the second engagement portion comprises an inclined surface such that the projection portion can smoothly slide over the second engagement portion without getting caught by the second engagement portion when the developing agent container is slid on the support portion and mounted to the coupling, it is only necessary to place the developing agent container on the support portion and push the developing agent container toward the coupling. Hence, it is easy to mount the developing agent container into the coupling.

BRIEF DESCRIPTION OF THE DRAWINGS

These and other objects and features of the present invention will become clear from the following description taken in conjunction with the preferred embodiments thereof with reference to the accompanying drawings, in which:

FIGS. 2(*b*) and 2(*c*) are perspective views showing modifications of the shape of the projection portion;

FIG. 4(*b*) is a perspective view showing the projection portion as it is immediately before moving passed the first engagement portion;

DESCRIPTION OF THE PREFERRED EMBODIMENTS

Figure 1:
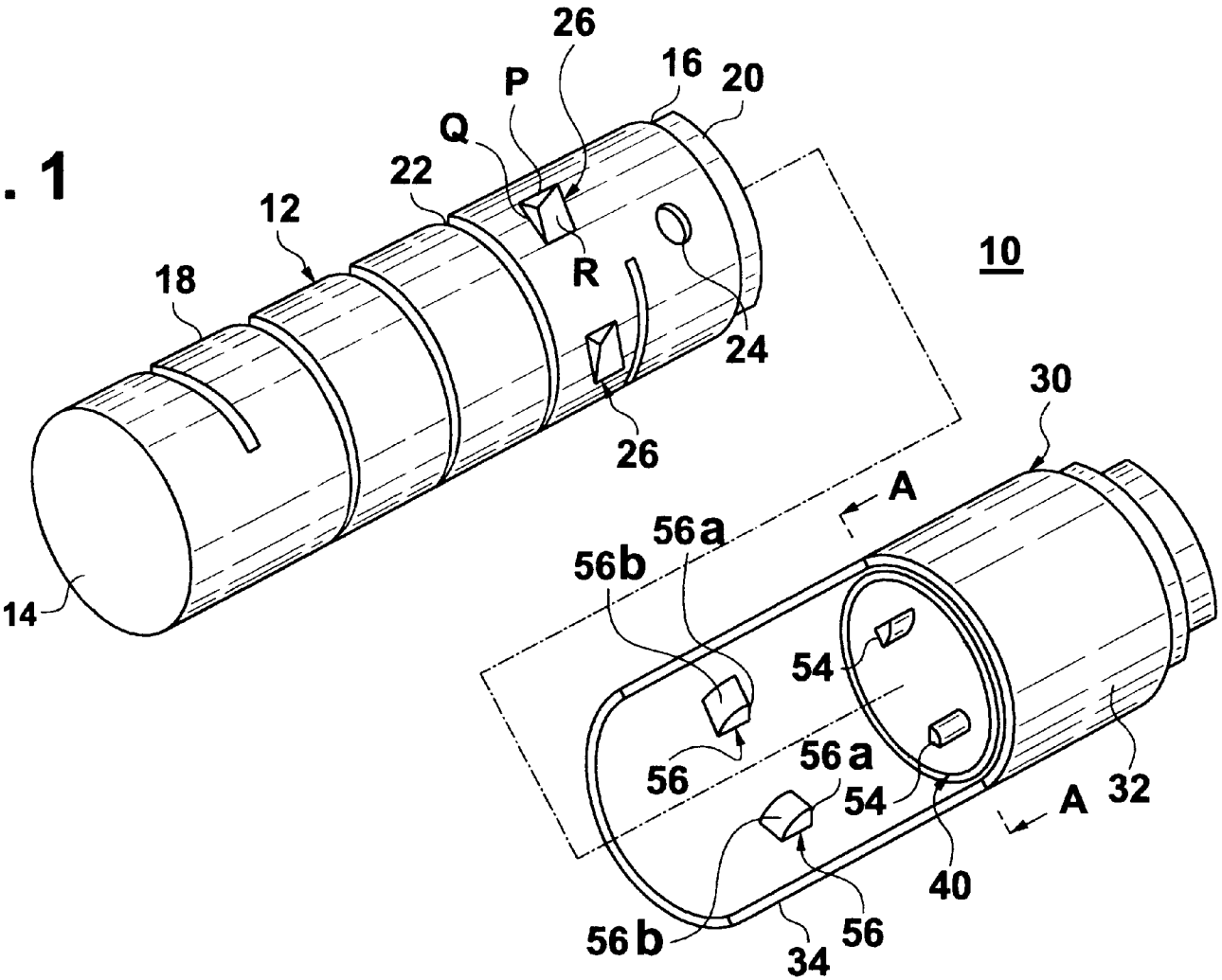
FIG. 1 is a perspective view of a toner bottle and a supply apparatus according to a preferred embodiment of the present invention.

In the following, a preferred embodiment of the present invention will be described with reference to the associated drawings. FIG. 1 is a perspective view of a developing agent container, namely, a toner bottle 12 and a supply apparatus 30 which form a developing agent supply apparatus 10 according to the present invention.

The toner bottle 12 comprises a cylindrical bottle 18 whose one end 14 is closed and the other end 16 is open, and a lid 20 which closes an opening portion when inserted to the other end 16. The toner bottle 12 is filled with toner particles which are a developing agent. A spiral groove 22 is formed in an outer peripheral surface of the cylindrical bottle 18, and a spiral ridge (not shown) corresponding to the groove 22 is formed in an inner surface of the cylindrical bottle 18. Further, a supply opening 24 is formed in the outer peripheral surface of the cylindrical bottle 18 in the vicinity of the other end 16. Through the supply opening 24, toner particles are supplied outside.

Figure 2:
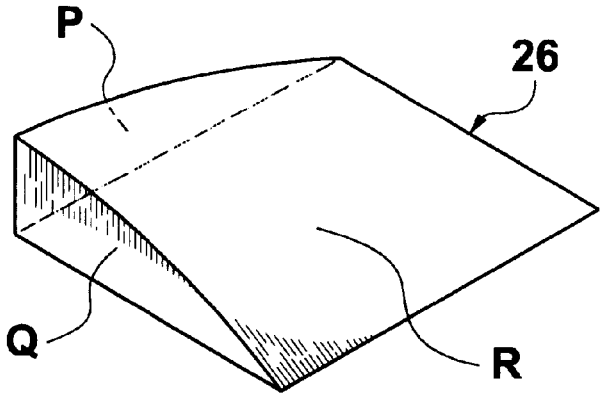
FIG. 2(*a*) is a perspective view showing a shape of a projection portion in the preferred embodiment.
Figure 2:
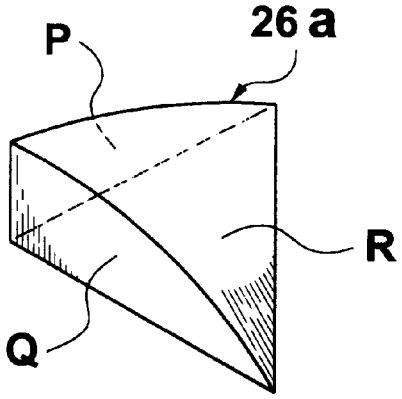
Figure 2:
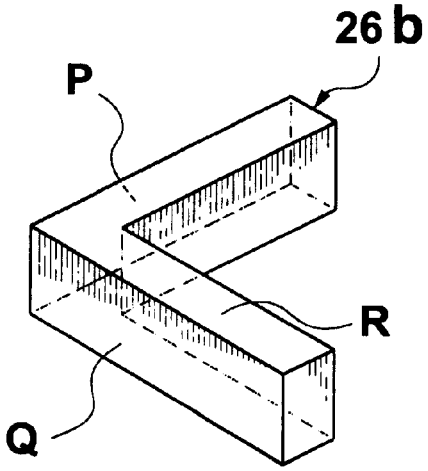

At least one (two in the preferred embodiment) projection portion 26 is formed in the outer peripheral surface of the cylindrical bottle 18 in the vicinity of the supply opening 24. The projection portion 26 has a first side surface P which is directed toward a circumferential direction of the toner bottle 12 and a second side surface Q which is directed toward the rear end 14 of the toner bottle 12. The first side surface P is preferably approximately perpendicular to the circumferential direction of the toner bottle 12, while the second side surface Q is preferably approximately perpendicular to an axial direction of the toner bottle 12. However, as described later, as far as the first side surface P and the second side surface Q can engage respectively with a first engagement portion and a second engagement portion, the directions and the angles of the first side surface P and the second side surface Q are not limited to this. In addition, a top surface R of the projection portion 26 is inclined as shown in FIGS. 1 and 2(*a*). Although the shape of the top surface R of the projection portion 26 is approximately square in the preferred embodiment as shown in FIG. 2(*a*), the top surface R may be an approximately triangle inclined surface as in the case of a projection portion 26*a* shown in FIG. 2(*b*), or alternatively, may not be an inclined surface as in the case of a projection portion 26*b* shown in FIG. 2(*c*) while the projection portion 26*b* comprises the first side surface P and the second side surface Q.

As shown in FIG. 1, the supply apparatus 30 comprises a stepped cylindrical portion 32 whose one end is closed and the other end is open, a support portion (developing agent container support portion) 34 which projects and extends from the cylindrical portion 32 and whose shape is like a column cut into two in a vertical direction, and a cylindrical coupling 40 which is housed within the cylindrical portion 32 for free rotation. The support portion 34 supports an outer peripheral surface of the toner bottle 12 which is mounted to the supply apparatus 30.

Figure 5:
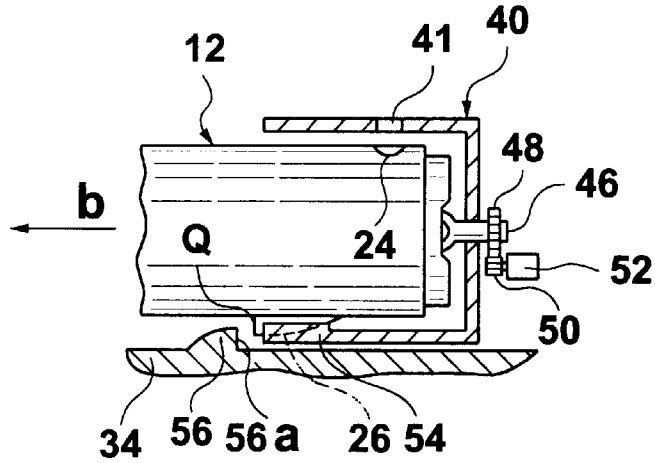
FIGS. 5(*a*) through 5(*c*) are views showing respective steps of pulling the toner bottle from a coupling.
Figure 5:
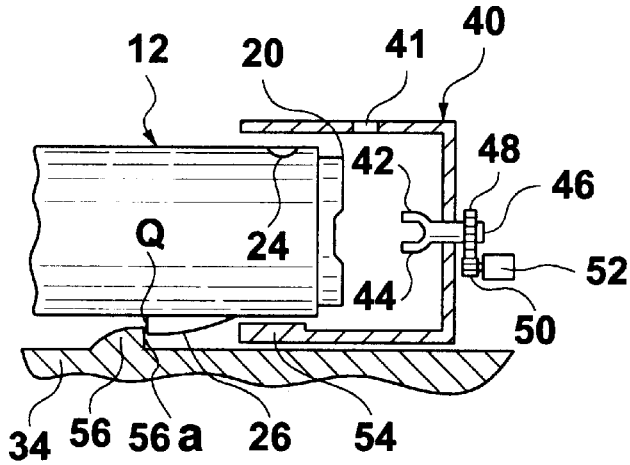
Figure 5:
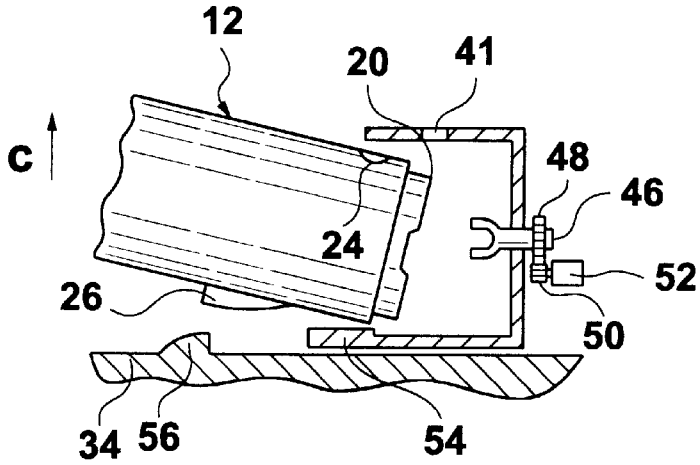

In a central portion along a rear edge of the coupling 40, a rotation rod 46 is fixed which comprises two engagement claws 42 and 44 which project toward inside the coupling 40, as shown in FIG. 5(*b*). As the engagement claws 42 and 44, due to elastic force thereof, fit into concave portions (not shown) which are formed in a central portion of the lid 20 of the toner bottle 12, the toner bottle 12 is supported with respect to the coupling 40. The rotation rod 46 of the coupling 40 is linked to a motor 52 through two gears 48 and 50. The rotation rod 46 and the coupling 40 rotate driven by the motor 52. The engagement claws 42 and 44 fit into the concave portions of the lid 20 of the toner bottle 12 are freely rotatable within the concave portions, and therefore, the engagement claws 42 and 44 do not transmit rotation of the rotation rod 46 to the toner bottle 12.

Referring to FIG. 1 again, at least one (two in the preferred embodiment) first engagement portion 54 is formed as a projection in an inner peripheral surface of the coupling 40. The first engagement portion 54 comprises a side surface which is approximately perpendicular to a circumferential direction of the coupling 40, which allows the side surface to abut the first side surface P of the projection portion 26 of the toner bottle. Further, at least one (two in the preferred embodiment) second engagement portion 56 is formed as a projection in an inner peripheral surface of the support portion 34 of the supply apparatus 30, at a position corresponding to the first engagement portion 54 described above. The second engagement portion 56 comprises a side surface 56*a* which is approximately perpendicular to an axial direction of the cylindrical portion 32 of the supply apparatus 30, and a top surface 56*b* which is an inclined surface. Although the second engagement portion 56 is disposed to the support portion 34 of the supply apparatus 30 in the preferred embodiment, the second engagement portion 56 may be disposed to other portion which is independent of the supply apparatus 30.

Now, mounting and detaching of the toner bottle and other operations in the developing agent supply apparatus 10 having such a structure above will be described.

Figure 3:
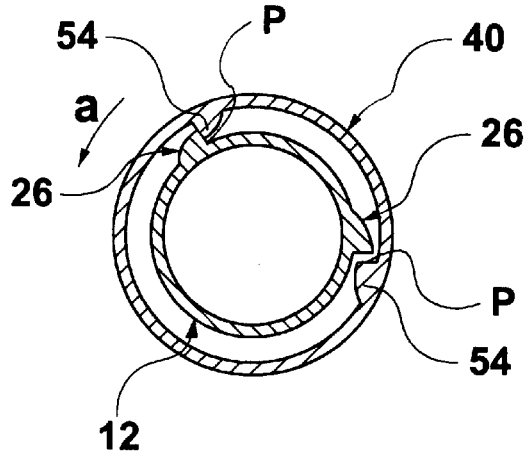
FIG. 3 is a cross sectional view of the toner bottle as it is mounted to the supply apparatus taken along the line A—A in FIG. 1.
Figure 4:
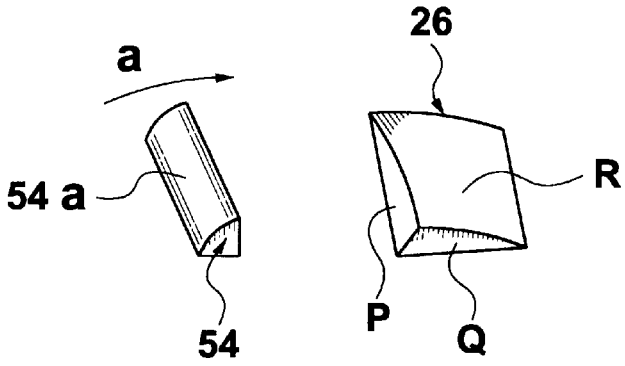
FIG. 4(*a*) is a perspective view showing the projection portion as it is immediately before abutting a first engagement portion.
Figure 4:
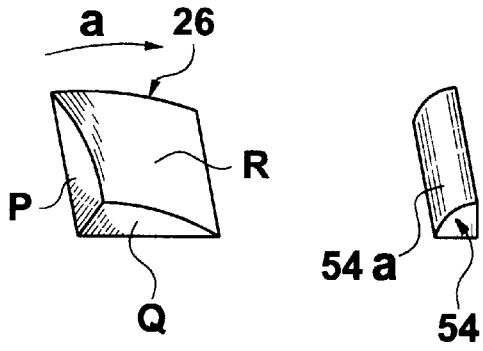

As described earlier, the toner bottle 12 is mounted to the supply apparatus 30 as the end portions of the toner bottle 12 are inserted to and supported by the coupling 40. When the motor 52 (See FIG. 5) rotates in this condition, as shown in FIG. 3, the coupling 40 is rotated in the direction of an arrow a. At this stage, the first engagement portion 54 of the coupling 40 abuts and pushes the first side surface P of the projection portion 26 of the toner bottle 12, whereby the coupling 40 rotates the toner bottle 12 in the direction of the arrow a. The rotation in turn permits the spiral ridge which is formed in the inner peripheral surface of the toner bottle 12 to carry toner particles contained within the toner bottle 12 toward the coupling 40, so that the toner particles are supplied from the supply opening 24 to a developing apparatus not shown through a restricting opening 41 of the coupling 40 (See FIG. 5). FIG. 4(*a*) shows a condition immediately before the first engagement portion 54 of the coupling 40 abuts and pushes the first side surface P of the projection portion 26 of the toner bottle 12.

On the other hand, when the rotation of the coupling 40 stops, the toner bottle 12 is stopped by means for detecting supply opening position (not shown) at such a position which always directs the supply opening 24 to above. It is possible to pull out the toner bottle 12 from the supply apparatus 30 during replacement when the toner bottle 12 is stopped at this predetermined position. However, when for some reason the toner bottle 12 fails to stop at the predetermined position so that it is not possible to pull out the toner bottle 12, the toner bottle 12 may be manually rotated in a direction in which the first side surface P of the projection portion 26 of the toner bottle 12 separates from the first engagement portion 54 of the coupling 40, that is, the direction of the arrow a. At this stage, as shown in FIG. 4(*b*), the first engagement portion 54 can get over the projection portion 26 as if to slide up along the inclined surface R of the projection portion 26, and therefore, the projection portion 26 can move passed the first engagement portion 54 without getting caught by the first engagement portion 54. Hence, it is possible to manually rotate the toner bottle 12 up to the predetermined position described earlier and pull out the toner bottle 12 in an easy manner independently of the coupling 40. Although an inclined surface 54*a* is formed in the first engagement portion 54 as well of the coupling 40 in the preferred embodiment as shown in FIGS. 4(*a*) and 4(*b*), as far as the projection portion 26 of the toner bottle 12 comprises an inclined surface, a similar function is ensured even without the inclined surface 54*a*.

During replacement of the empty toner bottle 12, the toner bottle 12 mounted to the coupling 40 is pulled in the direction of an arrow b as shown in FIG. 5(*a*). This disengages the engagement claws 42 and 44 from the concave portions of the lid 20 of the toner bottle 12 as shown in FIG. 5(*b*). In a moment of disengagement, the toner bottle 12 customarily tends to spring out of the coupling 40 thereby allowing toner particles accumulated in the coupling 40 to spurt out as dusty smokes. However, in the preferred embodiment, as the engagement claws 42 and 44 disengage and the toner bottle 12 recedes from the coupling 40, the second side surface Q of the projection portion 26 of the toner bottle 12 abuts the side surface 56*a* of the second engagement portion 56 of the support portion 34, which in turn temporarily stops the movement of the toner bottle 12 before the inserting-side end of the toner bottle 12 departs the coupling 40. At this stage, as shown in FIG. 5(*b*), the supply opening 24 of the toner bottle 12 is within the coupling 40 and the end of the toner bottle 12 covers the opening portion of the coupling 40. As shown in FIG. 5(*c*), the toner bottle 12 is pulled out from the coupling 40 after lifted in the direction of an arrow c, i.e., lifted up from this condition, and hence, the toner bottle 12 is prevented from jumping out from the coupling 40, and it is therefore possible to prevent toner particles from jetting out and scattering as dusty smokes. This prevents toner particles from dirtying the hands and/or clothes of the operator, the image forming apparatus and around the same.

Figure 6:
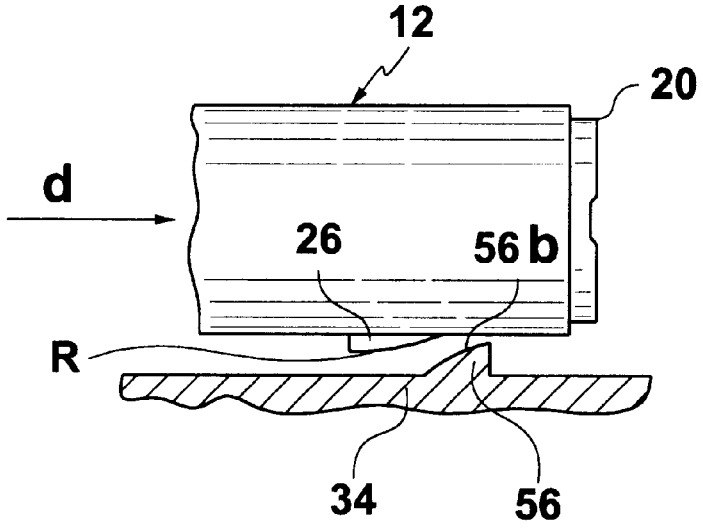
FIGS. 6(*a*) and 6(*b*) are views showing respective steps of mounting the toner bottle to the coupling.
Figure 6:
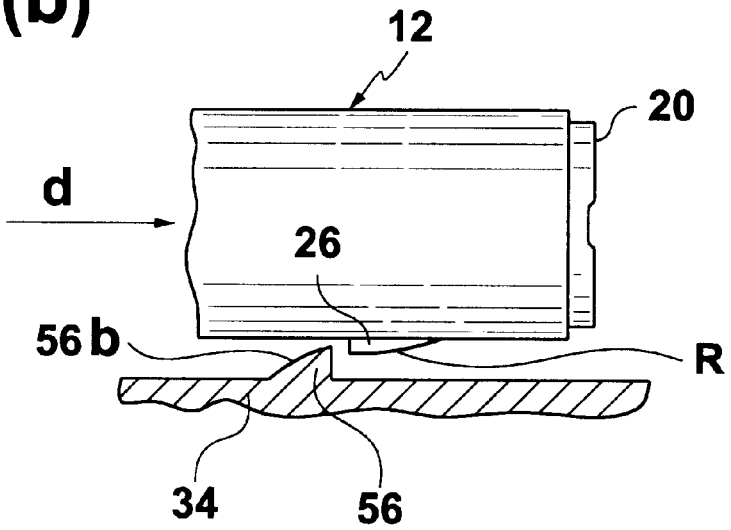

To mount a new toner bottle 12, as shown in FIG. 6(*a*), the new toner bottle 12 is pushed in the direction of an arrow d as if to slide the toner bottle 12 on the support portion 34. At this stage, with the inclined surface 56*b* of the second engagement portion 56 and the inclined surface R of the projection portion 26 of the toner bottle 12 sliding in contact with each other, the projection portion 26 passes over the second engagement portion 56, thereby creating a condition as that shown in FIG. 6(*b*). As the toner bottle 12 is further pushed in the direction of the arrow d, the toner bottle 12 is inserted into the coupling 40 and consequently mounted to the supply apparatus 30. As described above, in the preferred embodiment, since it is only necessary to push the toner bottle 12 as if to slide the toner bottle 12 on the support portion 34 for the purpose of mounting the toner bottle 12 to the supply apparatus 30, the toner bottle 12 which contains a large quantity of toner particles is easily attached without tilting the toner bottle 12. While the preferred embodiment requires that both the projection portion 26 of the toner bottle 12 and the second engagement portion 56 of the support portion 34 comprise inclined surfaces, it is possible to mount the toner bottle 12 in the manner described above as far as either one of the two comprises an inclined surface.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

For example, with the toner bottle 12 mounted to the supply apparatus 10, namely, the coupling 40, a convex portion or a concave portion may be formed in the outer peripheral surface of the toner bottle 12 at such a position corresponding to the second engagement portion 56, in such a manner that the toner bottle 12 vibrates vertically as the convex portion or concave portion engages with the second engagement portion, and toner particles inside the toner bottle 12 crumble for easier feeding toward the supply opening 24. In other words, the second engagement portion 56 which serves as a stopper for the toner bottle 12 may be used also as a projection for shaking the toner bottle 12.

Further, a side surface for transmitting rotation force to the toner bottle 12, a side surface for temporarily stopping movement of the toner bottle 12 when abutting the second engagement portion 56, and a concave portion comprising an inclined surface for passing over the first engagement portion 54 when the toner bottle 12 is manually rotated within the coupling 40 may be formed in the outer peripheral surface of the toner bottle 12, instead of the projection portion 26 which is disposed to the toner bottle 12.

In addition, although the preferred embodiment above is related to a supply apparatus which uses a toner bottle which is filled with toner particles, the present invention is applicable also to a developing agent supply apparatus which uses a developing agent container which is filled with other powder-like developing agent.

What is claimed is:

1. A developing agent supply apparatus comprising:

a developing agent container which is provided with a projection portion in an outer surface thereof, the projection portion including a first surface and a second surface;

a cylindrical coupling into which the developing agent container is detachable mounted, the cylindrical coupling being provided with a first engagement portion in an inner peripheral surface thereof; and a second engagement portion, wherein when the cylindrical coupling is rotated in a predetermined direction with the developing agent container mounted to the cylindrical coupling, the first engagement portion abuts and pushes the first surface of the projection portion so that the developing agent container is rotated in the predetermined direction, and wherein when the developing agent container is pulled out from the cylindrical coupling, the second surface of the projection portion abuts the second engagement portion, whereby movement of the developing agent container is temporarily restricted before the developing agent container is completely pulled out from the cylindrical coupling.

2. The developing agent supply apparatus as claimed in claim 1, further comprising a support portion which guides the developing agent container into the cylindrical coupling or out from the cylindrical coupling, wherein the second engagement portion is provided in the supply portion.

3. The developing agent supply apparatus as claimed in claim 2, wherein at least one of a contact surface of the projection portion and a contact surface of the second engagement portion is inclined, the contact surfaces of the projection portion and the second engagement portion being in contact with each other when the developing agent container is fit into the cylindrical coupling guided by the support portion.

4. The developing agent supply apparatus as claimed in claim 1, wherein the projection portion, the first engagement portion and the second engagement portion are provided by twos.

5. The developing agent supply apparatus as claimed in claim 1, wherein the developing agent container has a cylindrical shape and includes a spiral projection in an inner peripheral surface thereof.

6. The developing agent supply apparatus as claimed in claim 1, further comprising drive means for drive-rotating the cylindrical coupling.

7. A developing agent container used in a developing agent supply apparatus comprising a cylindrical coupling which is provided with a first engagement portion in an inner peripheral surface thereof and into which the developing agent container is detachable mounted, and a second engagement portion, said developing agent container comprising:

a container body which contains a developing agent;

a supply opening which is provided at the container body and provides the developer contained within the container body to the outside; and a projection portion which is provided at the container body and includes a first surface and a second surface, wherein when the cylindrical coupling is rotated in a predetermined direction with the developing agent container mounted to the cylindrical coupling, the first engagement portion abuts and pushes the first surface of the projection portion so that the developing agent container is rotated in the predetermined direction, and wherein when the developing agent container is pulled out from the cylindrical coupling, the second surface of the projection portion abuts the second engagement portion, whereby movement of the developing agent container is temporarily restricted before the developing agent container is completely pulled out from the cylindrical coupling.

8. The developing agent container as claimed in claim 7, wherein the developing agent supply apparatus further comprises a support portion which guides the developing agent container into the cylindrical coupling or out from the cylindrical coupling, and wherein the second engagement portion is provided in the supply portion.

9. The developing agent container as claimed in claim 8, wherein at least one of a contact surface of the projection portion and a contact surface of the second engagement portion is inclined, the contact surfaces of the projection portion and the second engagement portion being in contact with each other when the developing agent container is fit into the cylindrical coupling guided by the support portion.

10. The developing agent container as claimed in claim 7, wherein the projection portion, the first engagement portion and the second engagement portion are provided by twos.

11. The developing agent container as claimed in claim 7, wherein the container body has a cylindrical shape and includes a spiral projection in an inner peripheral surface thereof.

* * * * *